US012778334B2

(12) United States Patent
Altenhoelscher et al.

(10) Patent No.: US 12,778,334 B2
(45) Date of Patent: Nov. 3, 2026

(54) WINDOW FLOWER-BOX BRACKET

(71) Applicants: Thomas Altenhoelscher, Gladbeck (DE); Thomas Storck, Gelsenkirchen (DE); Peter Sommer, Essen (DE)

(72) Inventors: Thomas Altenhoelscher, Gladbeck (DE); Thomas Storck, Gelsenkirchen (DE); Peter Sommer, Essen (DE)

( * ) Notice: Subject to any disclaimer, the term of this patent is extended or adjusted under 35 U.S.C. 154(b) by 238 days.

(21) Appl. No.: 18/578,237

(22) PCT Filed: Jul. 26, 2021

(86) PCT No.: PCT/EP2021/070793
§ 371 (c)(1),
(2) Date: Jan. 10, 2024

(87) PCT Pub. No.: WO2023/006169
PCT Pub. Date: Feb. 2, 2023

(65) Prior Publication Data

US 2024/0374068 A1 Nov. 14, 2024

(51) Int. Cl.
*A47H 27/00* (2006.01)

(52) U.S. Cl.
CPC ..... *A47H 27/00* (2013.01)

(58) Field of Classification Search
CPC ..... A47H 27/00; A47G 7/044; A47G 7/045; A47G 7/04; E06B 7/28; E06B 9/17; A01G 9/02; A01G 9/024
See application file for complete search history.

(56) References Cited

U.S. PATENT DOCUMENTS 1,955,476 A * 4/1934 Torgersen ..... A47G 7/044 248/312.1
2,302,737 A * 11/1942 Bearden ..... A47G 7/044 248/224.7
4,048,754 A * 9/1977 Laux ..... A01G 9/02 217/65
4,149,339 A * 4/1979 Hall ..... A01G 9/024 383/106
4,848,610 A * 7/1989 Lai ..... A47G 7/044 211/186

(Continued)

FOREIGN PATENT DOCUMENTS

AT 7016 U1 * 7/2004 ..... E06B 7/28
CA 2016896 C * 8/1993 ..... A47H 27/00

(Continued)

*Primary Examiner* — Patrick D Hawn
(74) *Attorney, Agent, or Firm* — Andrew Wilford

(57) ABSTRACT

The invention relates to a flower box holder (1) for window frames which is used to secure flower boxes and decorative elements, e.g. planters, plant boxes or the like, and to prevent same from falling. To this end, the flower box holder (1) has: a hooked holding profile (2) which can be brought into engagement with a window frame profile; at least one holding element (3) which can be fixedly connected to the hooked holding profile (2) of the flower box holder (1) and by means of which at least one flower box or decorative element can be held; and a receiving part (5) which is arranged between the hooked holding profile (2) and the holding element (3) of the flower box holder (1) and by means of which a lower end portion of a roller shutter belonging to a window shutter frame can be closed.

11 Claims, 6 Drawing Sheets

(56) References Cited

U.S. PATENT DOCUMENTS

| | | | | | |
|---|---|---|---|---|---|
| 5,127,188 | A * | 7/1992 | Shaw | A47G 7/044 47/68 |
| 5,368,267 | A * | 11/1994 | Howard | A47G 7/044 248/274.1 |
| 5,711,502 | A * | 1/1998 | Emalfarb | A47H 27/00 248/302 |
| 5,738,319 | A * | 4/1998 | Grassi | A47G 7/044 248/215 |
| 7,229,056 | B2 * | 6/2007 | Rosser | A47G 7/044 47/68 |
| 9,179,794 | B2 * | 11/2015 | Darby | A01K 5/0114 |
| 11,149,903 | B2 * | 10/2021 | Darby | E06B 7/28 |
| 11,375,841 | B2 * | 7/2022 | Ellis | A47H 27/00 |
| 2003/0052073 | A1 * | 3/2003 | Dix | A47G 7/044 211/90.02 |
| 2007/0012855 | A1 * | 1/2007 | Rocavert | A47H 27/00 248/674 |
| 2011/0056765 | A1 * | 3/2011 | Enriquez | A47L 1/00 182/59 |
| 2013/0055636 | A1 * | 3/2013 | Ager | A01G 9/026 47/66.7 |

FOREIGN PATENT DOCUMENTS

| | | | | |
|---|---|---|---|---|
| CH | 635503 | A5 * | 4/1983 | A47H 27/00 |
| CZ | 3056 | U1 * | 5/1995 | |
| DE | 3726728 | A1 * | 2/1989 | A47H 27/00 |
| DE | 29821437 | U1 * | 4/2000 | A47H 27/00 |
| DE | 19918418 | C1 * | 10/2000 | A47H 27/00 |
| DE | 20113590 | U1 * | 11/2001 | E06B 7/28 |
| DE | 20022608 | U1 * | 12/2001 | A47H 27/00 |
| DE | 20014817 | U1 * | 1/2002 | A47H 27/00 |
| DE | 10132706 | B4 * | 11/2004 | A47H 27/00 |
| DE | 202004015119 | U1 * | 5/2005 | E06B 7/28 |
| DE | 202004007940 | U1 * | 9/2005 | A47H 27/00 |
| DE | 202006009599 | U1 * | 9/2006 | A47H 27/00 |
| DE | 202007012875 | U1 * | 1/2008 | F16B 7/025 |
| DE | 102007013437 | A1 * | 9/2008 | A47H 27/00 |
| DE | 202009002619 | U | 6/2009 | |
| DE | 202011003251 | U1 * | 6/2011 | A01G 9/02 |
| DE | 202011102310 | U1 * | 8/2011 | A47H 27/00 |
| DE | 202011051989 | U1 * | 1/2012 | A47G 7/044 |
| DE | 202015104529 | U1 * | 11/2015 | A47H 27/00 |
| DE | 202022100412 | U1 * | 2/2022 | A01G 9/024 |
| EP | 0206994 | A1 * | 12/1986 | A47H 27/00 |
| EP | 0334770 | A1 * | 9/1989 | A47G 7/044 |
| EP | 0981949 | A1 * | 3/2000 | A01G 9/02 |
| EP | 1060697 | A1 * | 12/2000 | A01G 9/024 |
| EP | 1645180 | A1 * | 4/2006 | A01G 9/04 |
| EP | 2014204 | A1 * | 1/2009 | A47G 7/041 |
| EP | 2299043 | A | 3/2011 | |
| EP | 3524103 | A | 8/2019 | |
| EP | 3884816 | A | 9/2021 | |
| FR | 2626758 | A1 * | 8/1989 | A47H 27/00 |
| FR | 2859091 | A1 * | 3/2005 | A47H 27/00 |
| KR | 100791402 | B1 * | 1/2008 | A01G 9/045 |
| KR | 20100002611 | U * | 3/2010 | A01G 9/08 |
| KR | 20140147511 | A * | 12/2014 | A01G 9/026 |
| WO | WO-0215671 | A1 * | 2/2002 | A47G 7/044 |
| WO | WO-2018096283 | A1 * | 5/2018 | A01G 7/045 |

* cited by examiner

WINDOW FLOWER-BOX BRACKET

CROSS REFERENCE TO RELATED APPLICATIONS

This application is the US-national stage of PCT application PCT/2021/070793 filed 26 Jul. 2021 and claiming the priority of PCT patent application PCT/2021/070793 itself filed 26 Jul. 2021.

The invention relates to a flower-box holder for window frames, by means of which flower boxes and decorative elements, e.g. plant boxes, planters, or the like, may be secured and prevented from falling.

In known flower-box holders of this type, the flower boxes or decorative elements are mechanically attached to window sills or the like of the respective window openings, which may lead to damages to the window sills, the side panels, the windows, the panes or the like, and additionally does not offer reliable long-term prevention from falling.

Starting from the prior art outlined above, the underlying object of the invention is to provide a flower-box holder for window frames that, on the one hand, implements a securing and prevention of flower boxes and decorative elements from falling, and that additionally avoids damages to the window frames.

This problem is solved according to the invention in that the flower-box holder has a hooked holding profile that may be brought into engagement with a window frame profile, at least one holding element that may be fixedly connected to the hooked holding profile of the flower-box holder and by means of which at least one flower box or decorative element may be held, and a receiving part that is between the hooked holding profile and the holding element of the flower-box holder and by means of which a lower end portion of a roller shutter associated with the window shutter frame may be closed. A local fixing of the flower-box holder at the window opening is achieved, without the occurrence of mechanical damages or interferences, due to a shape of the hooked holding profile, by means of which it is guaranteed that a secure engagement is realized between the flower-box holder and the window frame profile of the window opening. Holding the flower boxes or decorative elements by means of the holding element of the flower-box holder avoids the need for the creation of mechanical connections between the flower boxes or decorative elements and fixtures in the window opening, e.g. window sills. Due to the receiving part of the flower-box holder, it is ensured that a roller shutter, of the window opening may be uninterruptedly lowered with its lower end into the flower-box holder during adjustment into the lowered state.

According to one advantageous embodiment of the flower-box holder according to the invention, its receiving part is formed as one piece with its hooked holding profile.

When the receiving part of the flower-box holder has a holding slot, by means of which the holding element may be fastened to the receiving part or to the hooked holding profile, preferably by means of fastening screws, it may be achieved that different holding elements may be attached to the receiving part or to the hooked holding profile in order to hold flower boxes or decorative elements with different dimensions. Alternatively, a configuration is naturally also possible in which the essential elements of the flower-box holder, namely the hooked holding profile, the receiving part, and the holding element, are all one piece.

A comparatively adaptable configuration of the flower-box holder according to the invention is possible if the holding element is a holding bracket. The dimensions of the holding bracket may hereby be selected such that they are adapted to the greatest extent to the dimensions of the flower box or decorative element to be held by means of the holding bracket.

The flower-box holder according to the invention advantageously has at least two holding brackets that are at the two end portions of the hooked holding profile. By this means, a secure holding is implemented of the respective flower box or decorative element on the flower-box holder.

Alternatively, it is possible to design the holding element as a receiving bag that may be fastened at an edge section of its bag opening in the holding slot on the receiving part side. The respective flower box or the respective decorative element may then be accommodated within the receiving bag that may be configured in any way.

It is naturally also possible to design the holding element of the flower-box holder as a securing belt, wherein the securing belt may then naturally be fastened to the receiving part of the flower-box holder. The respective flower box or the respective decorative element may then be firmly fastened to the flower-box holder by means of the securing belt.

When a height-adjustment device, by means of which the vertical spacing between an upper edge of the hooked holding profile and a support surface of the holding element may be varied, is between the hooked holding profile on the one side and the holding element on the other, the flower-box holder according to the invention may be adjusted with respect to its vertical dimension such that the possibility exists that the holding element contacts with its under side on a window sill or the like.

The height-adjustment device may be advantageously configured as a toothing or alternatively as a vertical pushing device with fastening screws. The dimensioning of a toothing is then selected such that, upon applying an adjustment force, a vertical adjustment of the holding element with respect to the hooked holding profile is possible, wherein the toothing forces are sufficient in order to then secure a fixed vertical position of the holding element when no adjustment force is exerted. Provided that a free displaceability of the holding element on the hooked holding profile is possible, the desired vertical position of the holding element may initially be set wherein afterwards the holding element may then be fastened on the hooked holding profile in the set vertical position by means of fastening screws.

In order to avoid damages to the window frame profile, it is advantageous when the flower-box holder according to the invention has at least one edge protection profile element that may be between the hooked holding profile or the holding part of the flower-box holder and the window frame profile. Depending on the configuration of the hooked holding profile or the window frame profile, multiple, if necessary, different edge protection profile elements may also be provided.

The flower-box holder according to the invention or its receiving part may be configured in a structurally less expensive and simple way, when the receiving part is between an outer surface of the hooked holding profile facing the flower box or decorative element and an outer surface of the flower box or decorative element facing the hooked holding profile. Correspondingly, the lower end portion of the roller shutter associated with the window shutter frame may be received between the outer surface of the hooked holding profile facing the flower-box holder or decorative element and the outer surface of the flower box or the decorative element facing the hooked holding profile.

It is advantageous, in order to guarantee in each case the fixed spatial arrangement between the flower box or the decorative element on the one side and the flower-box holder on the other, when the flower-box holder has at least one securing element that is/are on the hooked holding profile of the flower-box holder and that may grip around an upper edge of the outer surface of a flower box or decorative element facing the hooked holding profile.

A particularly reliable and fixed spatial arrangement of the flower box or the decorative element with respect to the flower-box holder may be achieved when a projection that may be accommodated in an accommodating recess designed in a bottom panel of the flower box or decorative element, is designed between the proximal and the distal end portions of the holding part.

In order to guarantee a secure and fixed attachment of the hooked holding profile of the flower-box holder on the window frame profile, it is advantageous when the hooked holding profile of the flower-box holder has a U-shaped recess, made of a connecting bar and two vertical legs projecting at right angles from the connecting bar, for the purpose of engaging with the window frame profile, wherein the vertical leg forming the end of the hooked holding profile on the window frame profile side has on its free end a small, in comparison to the corresponding dimension of the connecting bar, bend parallel to the connecting bar.

By means of the previously described embodiments of the flower-box holder according to the invention, flower boxes or decorative elements may be held in a controllable way on window sills of window frames without unacceptably stressing or damaging the window sills in any way.

The invention will subsequently be described in greater detail by way of embodiments with reference to the drawings in which.

One embodiment, subsequently explained in greater detail by way of FIGS. 1 to 3, of a flower-box holder 1 for window frames according to the invention, by means of which flower boxes and decorative elements, e.g., plant boxes, planters, or the like, may be held, functions to secure these flower boxes or decorative elements, not shown in the figs., and to prevent the same from falling.

Flower-box holder 1 has a hooked holding profile 2 for its defined spatial arrangement in or at the window opening. Flower-box holder 1 may be brought into engagement with a window frame profile by means of hooked holding profile 2. The dimensions of hooked holding profile 2 are adapted to those of the window frame profile in such a way that a fixed engagement is achieved between hooked holding profile 2 of flower-box holder 1 on the one hand and the window frame profile, not shown in the figs., on the other.

Figure 1:
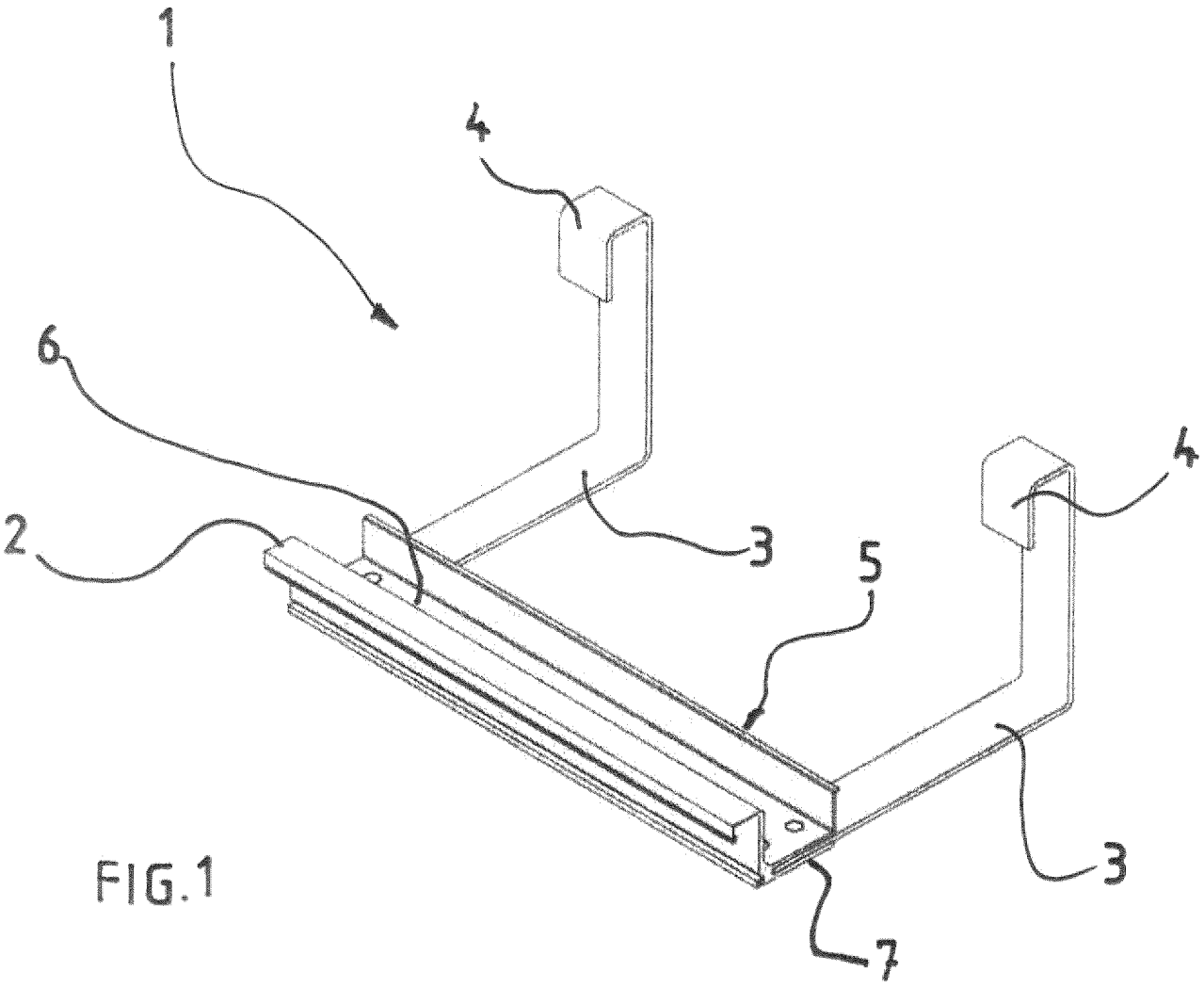
FIG. 1 is a perspective depiction of one embodiment of a flower-box holder for window frames according to the invention.

Holding elements 3, of which two examples, config.d in the form of holding brackets 3, are provided in the case of the exemplary embodiment shown in FIG. 1, function for the actual securing of the flower boxes or decorative elements, e.g., the plant boxes, planters, or the like. It arises from FIG. 1, that, in the depicted exemplary embodiment of flower-box holder 1, the two holding brackets 3 are on the lateral end portions of hooked holding profile 2. In the case of the embodiment shown in FIG. 1 of flower-box holder 1 according to the invention, the two holding brackets are equipped on their distal end portions with folded portions 4, by means of which a plant box or the like may be secured.

A receiving part 5 that is designed in the depicted exemplary embodiment as one piece with hooked holding profile 2, is between holding brackets 3 on the one side and hooked holding profile 2 of flower-box holder 1 on the other. Receiving part 5 forms a receiving groove 6, into which a lower end portion or a lower end of a roller shutter may be lowered, said roller shutter serving for that window opening in which flower-box holder 1 is provided. An area is created on flower-box holder 1 by receiving part 5 or its receiving groove 6 that is free of the flower box(es) or decorative element(s), so that when lowering the roller shutter, the window opening may be closed altogether, without interferences in the operation of the roller shutter device occurring due to flower-box holder 1.

Figure 2:
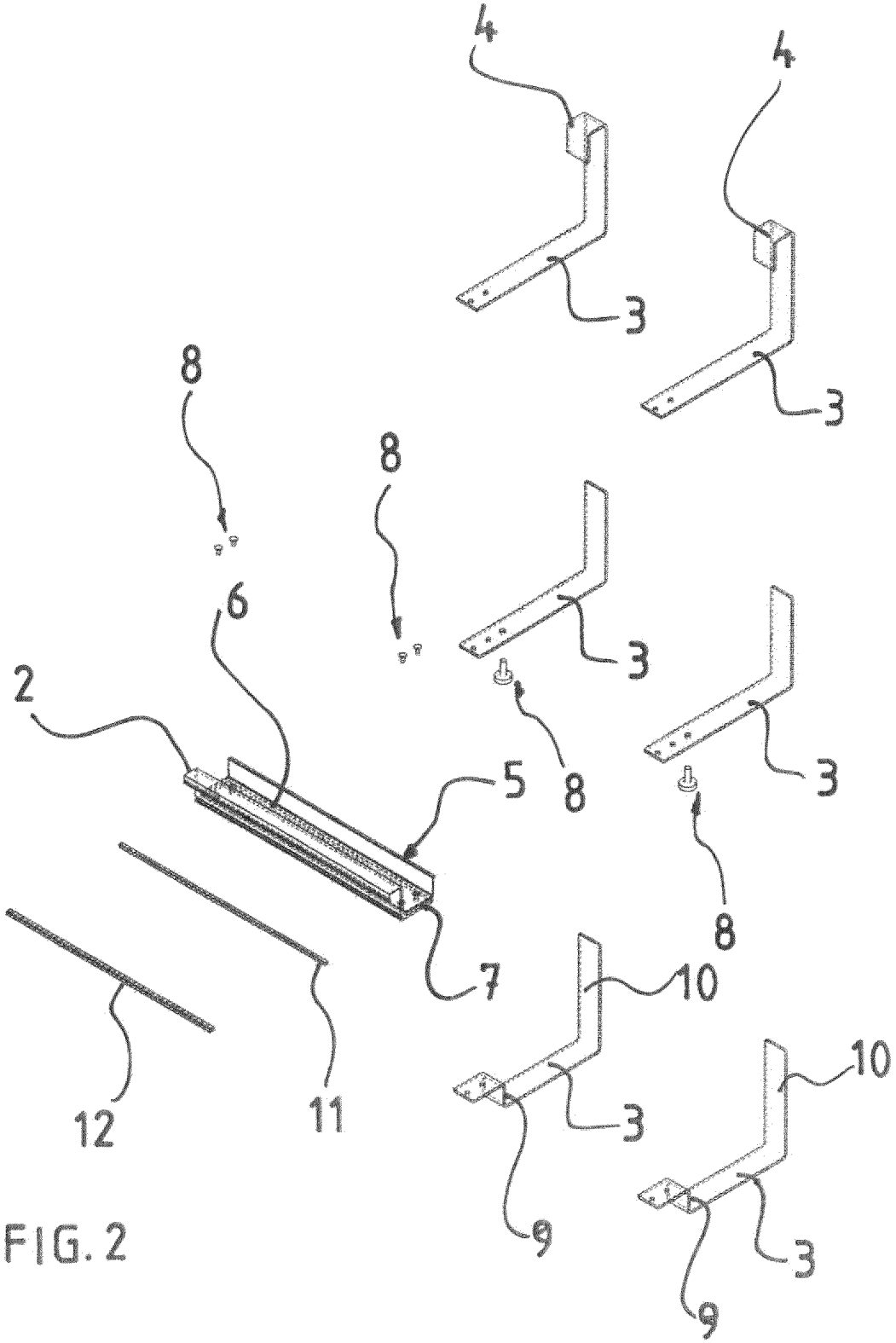
FIG. 2 is an exploded depiction of the embodiment shown in FIG. 1 of the flower-box holder for window frames according to the invention, wherein different embodiments are shown for holding elements of the flower-box holder.

The receiving part 5 of the flower-box holder has as shown in FIGS. 1 and 2 an underneath receiving groove 6 that the receiving part forms, a holding slot 7, into which the end portions of holding brackets 3, proximal with respect to flower-box holder 1, may be inserted. For securing holding brackets 3 on receiving part 5, and thus on hooked holding profile 2, fastening screws 8, by means of which holding brackets 3 may be fastened within holding slot 7 of receiving part 5 of flower-box holder 1, are provided in the exemplary embodiment shown in FIGS. 1 and 2. Other fastening possibilities are naturally also conceivable and appropriate for implementing the flower-box holder according to the invention.

Three different exemplary embodiments for holding bracket 3 of flower-box holder 1 are shown in the perspective depiction in FIG. 2. In the case of holding brackets 3 shown at the top in FIG. 2, these have the embodiment also shown in FIG. 1.

In the case of holding brackets 3 depicted in the center in FIG. 2, these are equipped without any type of folds or bends at their distal ends. By this means, double walled flower boxes 1 may be received, wherein holding brackets 3 are hidden in the interior.

In the embodiment of holding brackets 3, depicted at the bottom in FIG. 2 and arranged to be hidden, these are config.d without bends or folds at their distal ends. At their proximal end portions of the holding slot 7, last mentioned holding brackets 3 have a vertical step 9. A planter, plant box, or the like may be secured between vertical step 9 and vertical portions 10 of holding bracket 3 lying opposite the same.

Furthermore, two edge protection profile elements 11, 12 that are between hooked holding profile 2 of flower-box holder 1 on the one side and the window frame profile, not depicted in the figs., on the other, and are supposed to avoid damages to the window frame profile, are part of the embodiment of flower-box holder 1 according to the invention shown in FIGS. 1 and 2.

Figure 3:
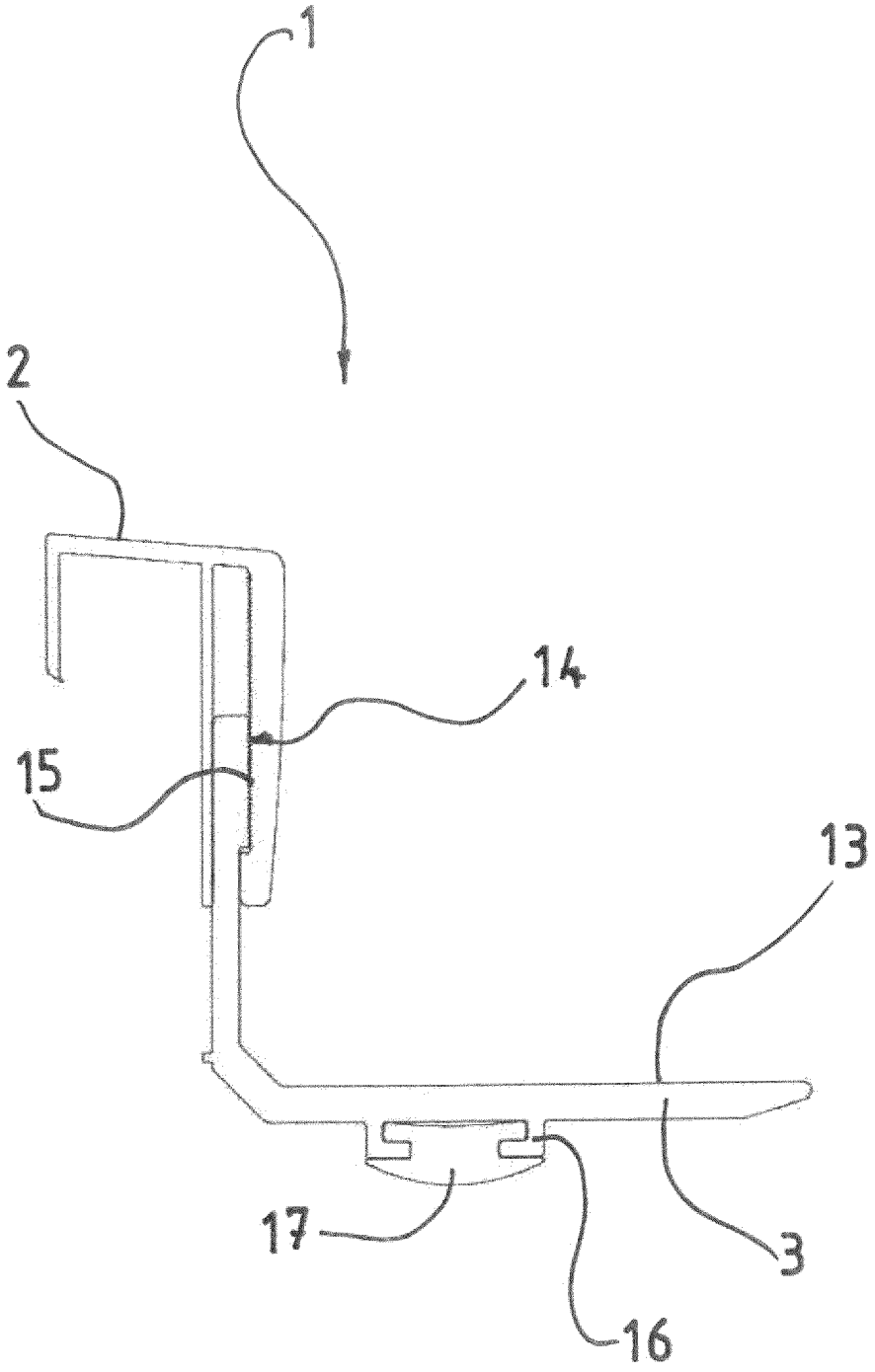
FIG. 3 is a schematic depiction of a further embodiment of the flower-box holder for window frames according to the invention.

A further embodiment of flower-box holder 1 according to the invention is shown in a schematic depiction in FIG. 3. Receiving part 5 including receiving groove 6 is not shown in FIG. 3 for reasons of clarity.

Holding element 3 of the embodiment of flower-box holder 1 according to the invention shown in FIG. 3 forms a supporting surface 13 for flower boxes or decorative elements. In order to implement a vertical adjustability of supporting surface 13 of holding element 3 with respect to the upper edge of the window frame profile, not shown in FIG. 3, a height-adjustment device 14 is designed between hooked holding profile 2 of flower-box holder 1 and holding element 3. By means of this height-adjustment device 14, holding element 3 may be moved upward in the vertical direction and downward in the vertical direction with respect to hooked holding profile 2.

This height-adjustment device 14 may be implemented, for example, in that a toothing 15 is designed between hooked holding profile 2 and holding element 3, wherein starting from an adjusting force, a vertical adjustment of the two parts relative to one another is possible, and in the absence of an adjustment force, a securing of holding element 3 in the vertical position set at hooked holding profile 2 is ensured. Alternatively, it is possible to provide a free displaceability between holding element 3 on the one side and hooked holding profile 2 on the other, wherein, in the selected vertical position, holding element 3 may then be fastened, e.g., by means of fastening screws, in the vertical position adopted on hooked holding profile 2.

In the case of the embodiment of flower-box holder 1 according to the invention shown in FIG. 3, holding element 3 is provided with a recess 16 on its bottom surface for a silicon profile 17, by means of which holding element 3 may be supported on a window sill or the like of the window opening without damaging the window sill or the like. Instead of silicon profile 17, individual adjustable feet may also be accommodated in recess 16.

Figure 4:
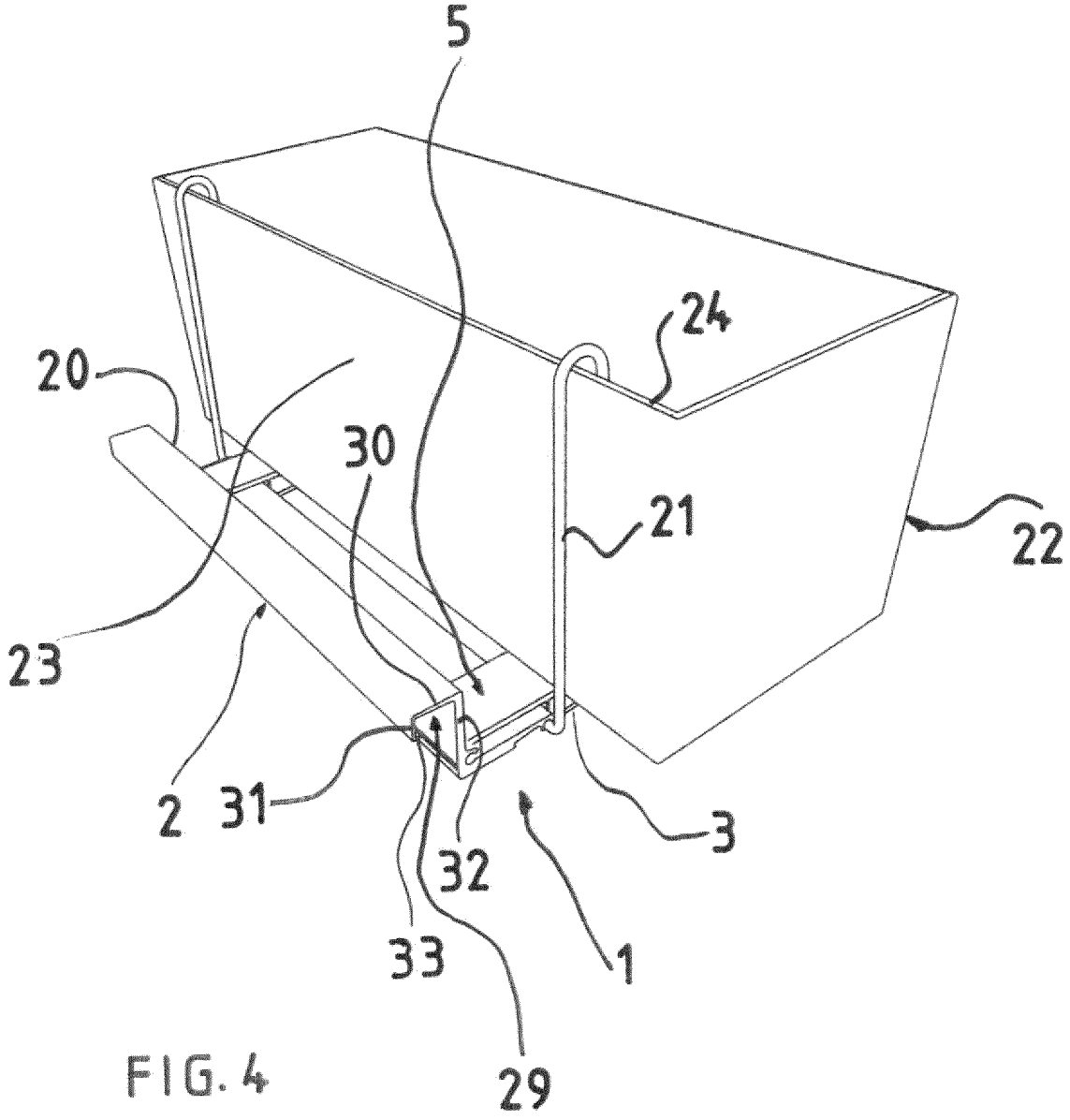
FIG. 4 is a perspective depiction of a further embodiment of a flower-box holder for window frames according to the invention with a flower box held by the flower-box holder.
Figure 5:
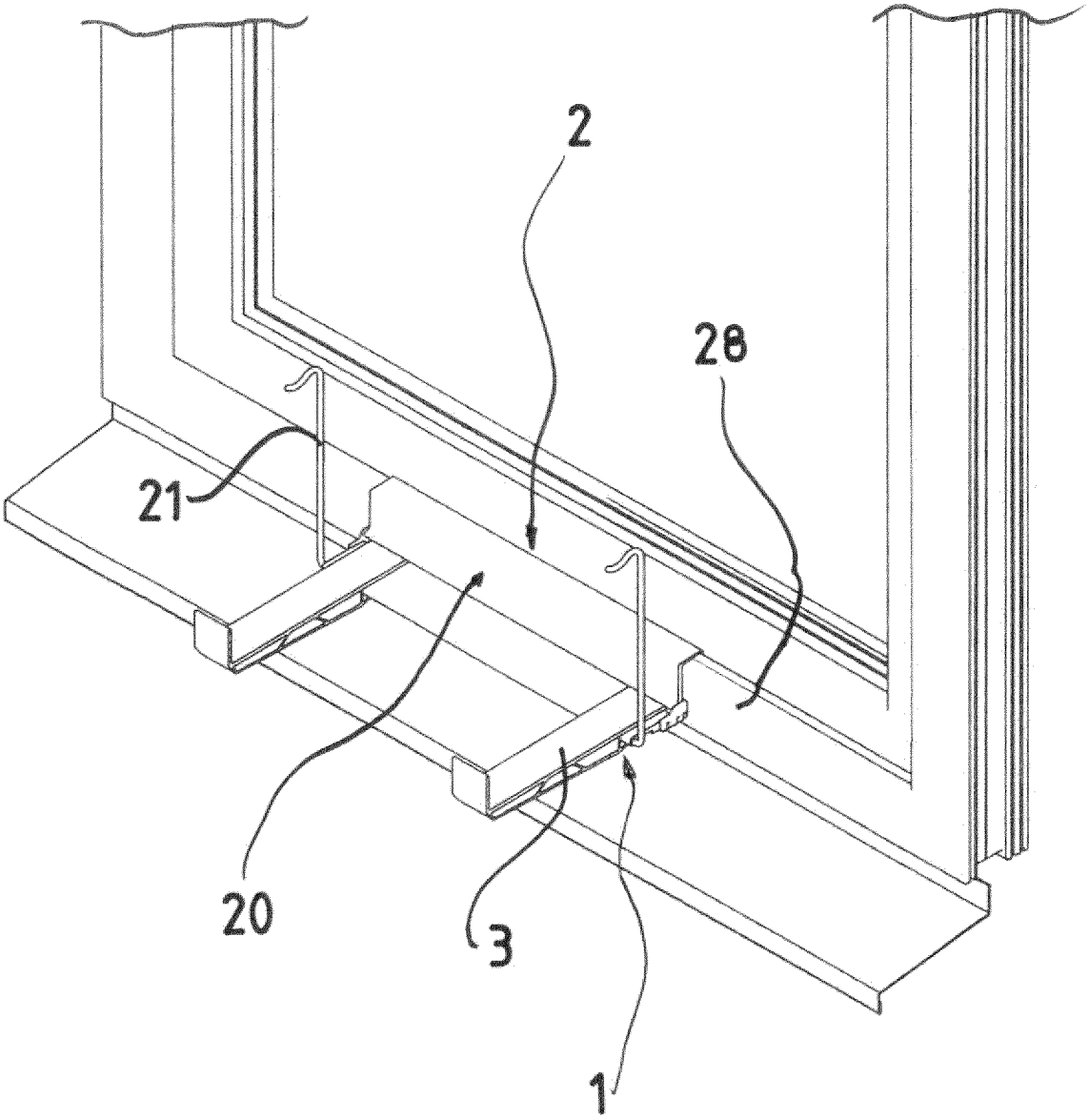
FIG. 5 is a perspective depiction of the embodiment shown in FIG. 4 of the flower-box holder according to the invention on a window frame profile.

A further embodiment of flower-box holder 1 according to the invention is shown in FIGS. 4 and 5. In the case of this embodiment of flower-box holder 1 according to the invention, its receiving part 5 is implemented in that a spacer is provided between an outer surface 20 of hooked holding profile 2 of flower-box holder 1 facing flower box 22 shown in FIG. 4 and an outer surface 23 of flower box 22 facing hooked holding profile 2, said spacer is sufficient to accommodate the lower end portion of the roller shutter. Receiving part 5 or the receiving space for the lower end portion of the roller shutter is thus formed by outer surface 20 of hooked holding profile 2 facing flower box 22, proximal end portion of holding element 3 or holding bracket 3, and outer surface 23 of flower box 22 facing hooked holding profile 2.

In the exemplary embodiment of flower-box holder 1 shown in FIGS. 4 and 5, hooked holding profile 2 of the same is equipped with two securing elements 21 in the area of the two holding brackets 3. Securing elements 21 are coupled or mounted in a suitable way on hooked holding profile 2. An upper edge 24 of outer surface 23 of flower box 22 facing hooked holding profile 2 may be gripped around by means of the folded or bent end portion at the upper end of the two securing elements 21, so that a securing of flower box 22 in a horizontal direction with respect to flower-box holder 1 may also be ensured.

As arises in particular from FIG. 4, hooked holding profile 2 has a U-shaped recess 29 for the purpose of engaging with window profile 28 shown in FIG. 5. U-shaped recess 29 is formed from a connecting bar 30 and two vertical legs 31, 32 projecting at right angles from connecting bar 30, and is open toward the bottom in FIGS. 4 and 5. A bend 33 that is oriented parallel to connecting bar 30, is config.d on vertical leg 31 or on its free end, forming the end of hooked holding profile 2 on the window frame profile side. A suspension or hooking is implemented between hooked holding profile 2 on the one side and window frame profile 28 on the other, by means of this bend 33, functioning as a rear grip, in conjunction with the enclosing of the sealing profile on the window frame profile side.

Figure 6:
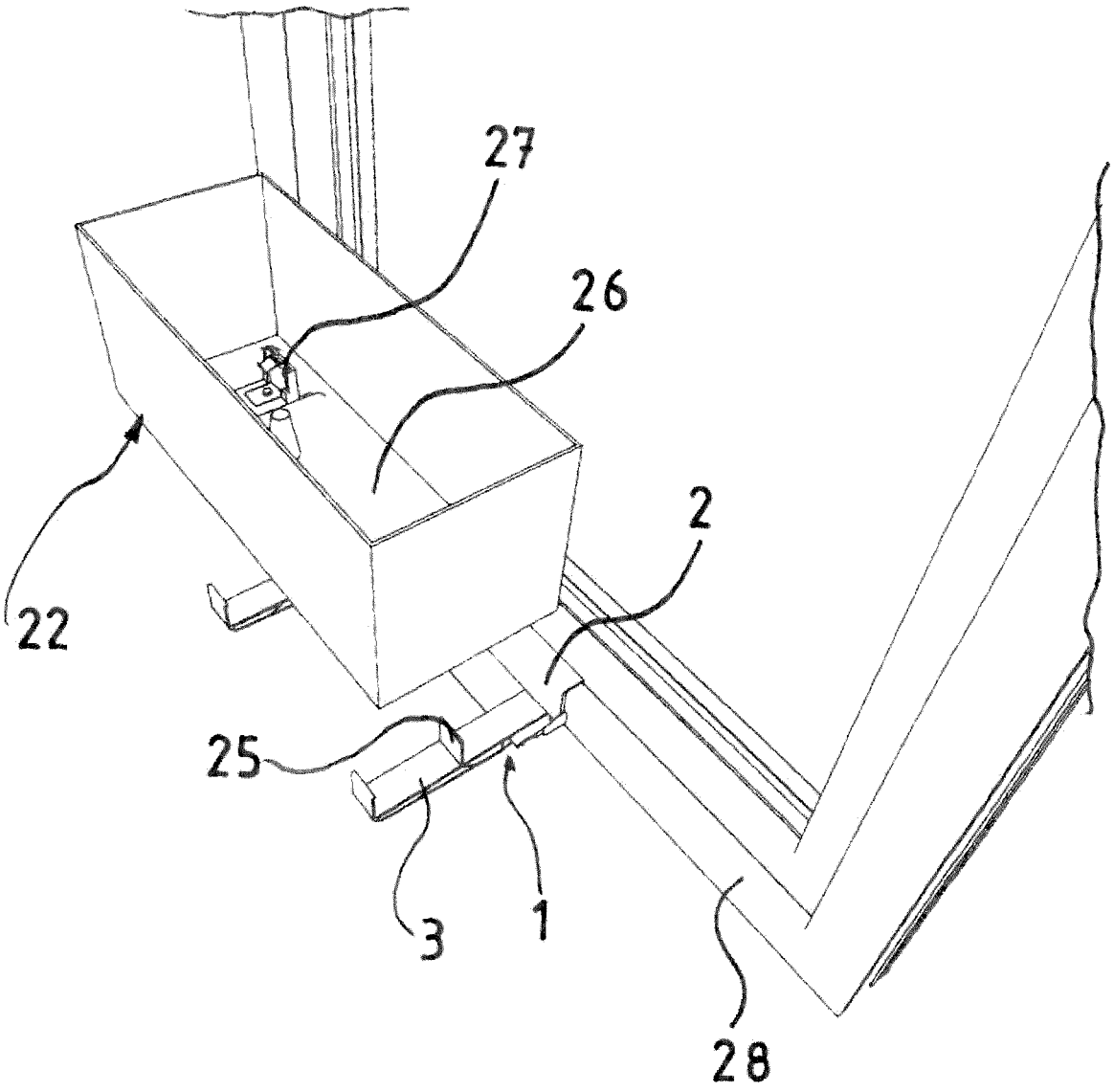
FIG. 6 is a perspective depiction of a further embodiment of the flower-box holder for window frames according to the invention with a flower box to be held by the flower-box holder.

In the case of the embodiment of flower-box holder 1 according to the invention shown in FIG. 6, a projection 25 is designed between the proximal and the distal end portions of the two holding parts or holding brackets 3. Projection 25 may be accommodated in an accommodating recess 27 that is config.d in a bottom panel 26 of flower box 22. When projection 25 or, two projections 25 as in the exemplary embodiment shown in FIG. 6, fit(s) in its/their assigned accommodating recesses 27 of bottom panel 26 of flower box 22, a simple latching connection may be implemented between flower-box holder 1 on the one side and flower box 22 on the other. This latching may only be deliberately released by actuating spring elements or the like, and thus contributes to an increased securing of flower box 22.

The invention claimed is:

1. A combination comprising:

a flower box having a bottom panel formed with a recess, and a flower-box holder having a hooked holding profile engageable with a window-frame profile, at least one holding element fixedly connectable to the hooked holding profile of the flower-box holder configured to hold the flower box, a receiving part between the hooked holding profile and the holding element of the flower-box holder and closable around a lower end portion of a roller shutter associated with a window shutter frame, and a projection accommodated in the recess of the bottom panel of the flower box between proximal and distal end portions of the holding element.

2. The combination according to claim 1, wherein the receiving part is one piece with the hooked holding profile.

3. The combination according to claim 1, wherein the receiving part has a holding slot that can configured to attach the holding element to the receiving part or to the hooked holding profile.

4. The combination according to claim 3, wherein the holding element is a holding bracket.

5. The combination according to claim 4, wherein at least two holding brackets are provided that are on both end portions of the hooked holding profile.

6. The combination according to claim 1, further comprising:

a height-adjustment device between the hooked holding profile on the one side and the holding element on the other configured to vary the vertical spacing between an upper edge of the hooked holding profile and a support surface of the holding element.

7. The combination according to claim 6, wherein the height-adjustment device has gear teeth or a vertical pushing device with fastening screws.

8. The combination according to claim 1, further comprising:

an edge-protecting profile element between the hooked holding profile or the receiving part of the flower-box holder and the window-frame profile.

9. The combination according to claim 8, wherein the receiving part is formed between an outer surface of the hooked holding profile facing the flower box and an outer surface of the flower box facing the hooked holding profile.

10. The combination according to claim 1, further comprising:

at least one securing element on the hooked holding profile of the flower-box holder and configured to grip around an upper edge of the outer surface of a flower box facing the hooked holding profile.

11. The combination according to claim 1, wherein the hooked holding profile has a U-shaped recess made of a connecting bar and two vertical legs projecting at right angles from the connecting bar for the purpose of engaging with the window-frame profile, the vertical leg forming the end of the hooked holding profile on the window-frame profile side having on its free end a bend that is smaller than the connecting bar parallel to the connecting bar.

* * * * *